United States Patent [19]

Gunnergaard

[11] 4,037,642

[45] July 26, 1977

[54] METHOD IN THE OPERATION OF AN APPARATUS FOR PRODUCING CASTINGS

[75] Inventor: Marius Gunnergaard, Lyngby, Denmark

[73] Assignee: Dansk Industri Syndikat A/S, Herlev, Denmark

[21] Appl. No.: 608,337

[22] Filed: Aug. 27, 1975

[30] Foreign Application Priority Data

Sept. 17, 1974 Denmark ..... 4909/74

[51] Int. Cl.[2] ..... B22D 33/00

[52] U.S. Cl. ..... 164/18

[58] Field of Search ..... 164/18, 187, 188, 130, 164/172, 173, 211, 335; 141/180

[56] References Cited

U.S. PATENT DOCUMENTS

| | | | |
|---|---|---|---|
| 3,237,661 | 3/1966 | Rosen | 141/180 |
| 3,744,551 | 7/1973 | Gunnergaard | 164/187 X |
| 3,802,486 | 4/1974 | Otaki | 164/187 |

*Primary Examiner*—Travis S. McGehee

*Attorney, Agent, or Firm*—Imirie, Smiley & Linn

[57] ABSTRACT

In a casting apparatus using a mould which comprises a horizontal series of identical mould parts and presents at least one casting cavity at each joint between successive mould parts, the mould is advanced stepwise through a pouring station with a length of step that equals a multiple of the thickness or axial length of each mould part.

4 Claims, 5 Drawing Figures

Pos. II
Pos. I
1
2
3
4
5
6
a
b
c
d
e
f

METHOD IN THE OPERATION OF AN APPARATUS FOR PRODUCING CASTINGS

BACKGROUND OF THE INVENTION

The invention relates to a method in the operation of an apparatus for producing castings in casting moulds consisting of identical mould parts which are produced successively by the compression of sand or a similar material in a pressing chamber and are from this chamber delivered one by one to a pouring track or guideway on which the casting mould is formed by the mould parts being placed closely together and advanced stepwise through a pouring station.

The functioning of such an apparatus normally comprises three main operations, viz. the production of the mould parts and the transfer of the latter to the pouring track or guideway, the insertion of cores and the pouring of the metal. These three operations are performed in timed relationship with each other, and the maximum capacity of the apparatus, reckoned in the number of cycles per unit of time, is consequently determined by the one of the three operations requiring the longest time. In most cases, this is the operation mentioned first, but according to the circumstances it may also be the insertion of cores or the pouring that is most time-consuming and consequently decisive of the capacity.

Certain types of castings require a comparatively long pouring time, and the present invention deals with the problem of making possible a prolongation of the pouring time for each mould cavity without the capacity of the apparatus being reduced.

With a view to this it is known in advance to let a casting apparatus comprise a mould part producing device in combination with two pouring tracks or guideways, so that the mould parts can from the pressing chamber be transferred alternately to one or the other of these guideways. For a given cycle period for the mould part producing device there will by this means be a period equal to twice the cycle period at disposal for the insertion of cores and the pouring, and the capacity may consequently normally be increased to the limit determined by the cycle period for the mould part production. This possibility has, however, only been created at the cost of considerable extra investments, since two separate pouring tracks or guideways with associated equipment are required. In addition, extra employees for operating and supervising the apparatus must also be included in the costs.

SUMMARY OF THE INVENTION

The present invention solves the problem in another and substantially cheaper way, viz. by the casting mould being moved through the pouring station with a length of step that is a multiple of the thickness of a mould part, preferably twice this thickness.

In this case, no extra pouring track or guideway is required, and the necessary constructional modifications in relation to apparatus structures already in existence are on the whole a minimum. While with these known structures the casting mould advances one mould part thickness or one module on the pouring track or guideway for each mould part production cycle or apparatus cycle, and a pouring is performed for each cycle, there will according to the invention only occur an advance of the mould for every other or possibly every third cycle, but on the other hand over a length corresponding to two or three modules, respectively. By this means, the period at disposal for the pouring operation will be almost doubled and trebled, respectively, and in the course of this period pouring will be performed in the cavities at two and three joints, respectively, in the mould. The most considerable gain in time is of course achieved if the pouring is performed simultaneously in both or all the cavities, and this may expediently be effected by means of an automatic equipment comprising several outlets which are mutually adjustable dependently on the thickness of the mould parts, this thickness determining the distance between the successive inlets of the casting mould.

BRIEF DESCRIPTION OF THE DRAWING

The method according to the invention is illustrated purely diagrammatically in the drawing which in FIGS. 1–5 shows the first phases of the production of a casting mould.

DESCRIPTION OF THE PREFERRED EMBODIMENTS

Figures 1, 2, 3, 4, 5:
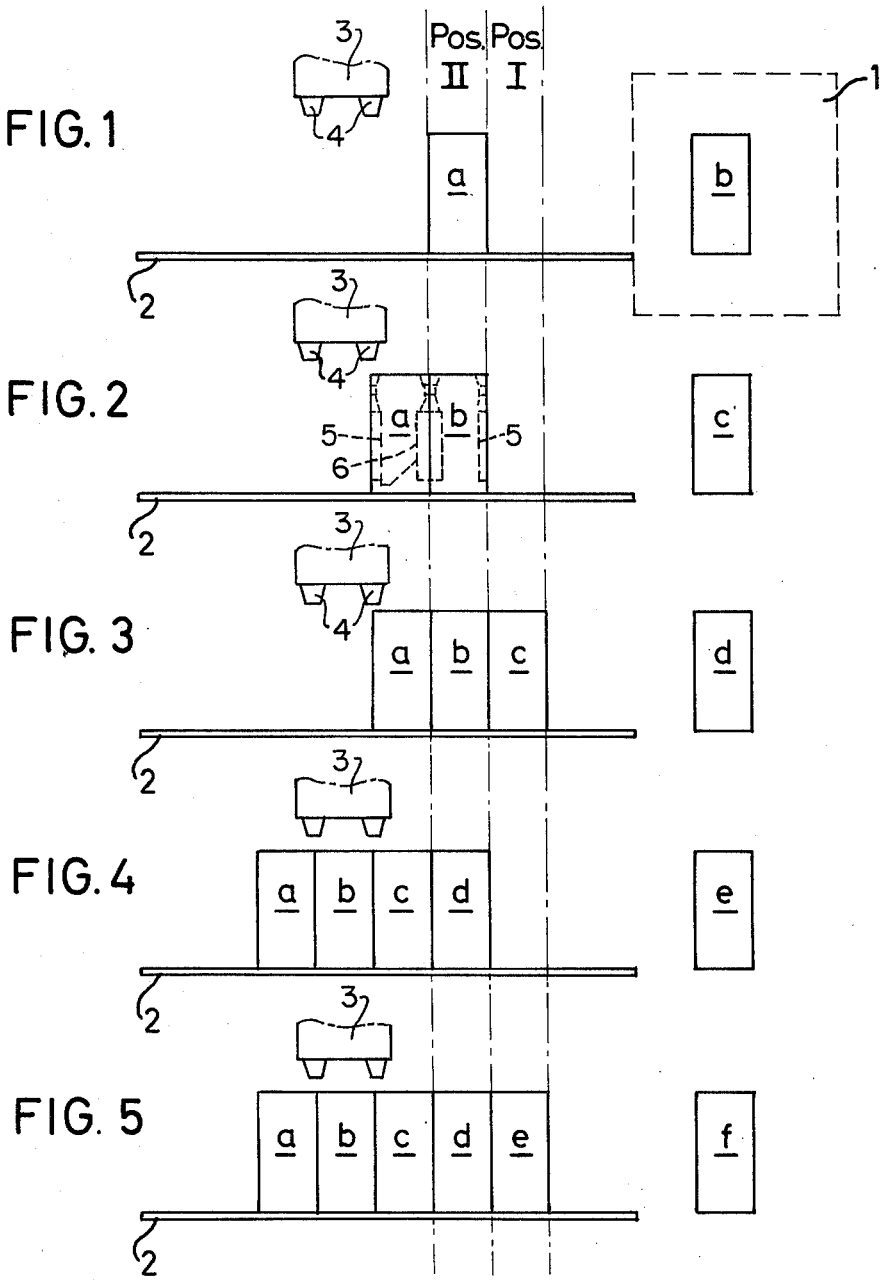

In the drawing, 1 indicates the mould part production device proper, the details of which form no part of the invention and are therefore not shown, and 2 is the pouring track or guideway of the apparatus, the details of which guideway and have also been omitted. A pouring device or ladle 3 having two outlets 4 is arranged above the guideway. The spacing of the outlets corresponds to the axial thickness of a mould part and may be adjustable as noted above.

FIG. 1 shows a first mould part *a* which has been led out into position II on the pouring track or guideway 2, while the next mould part *b* has just been finished in the device 1.

In FIG. 2 the mould part *b* has been advanced to the said position II, during which movement it has been added to the mould part *a* and has advanced the latter one module on the pouring track or guideway. At the same time, the next mould part *c* is produced in the device 1. In FIG. 2 it has also been illustrated that the mould parts are of the well known type having mould impressions 5 in the opposite sides thereof to form one or more complete casting cavities 6 at each joint between successive mould parts.

This mould part *c* is now, FIG. 3, advanced to position I so that it is added to the mould part *b* without the latter being displaced, and the succeeding mould part *d* is finished.

When this has been performed, this mould part *d* is added to *c* and advanced further on into position II, by which means the casting mould consisting of *a, b,* and *c* is advanced two modules on the pouring track or guideway and the pouring may be performed through both outlets of the device 3. The situation is now as shown in FIG. 4.

In this way the operation is continued with the production of mould parts *e, f* etc., every other mould part from the device 1 being advanced to position I, while the remaining mould parts are advanced one module further on to position II. By this means, the number of cycles for the stepwise advance of the casting mould on the pouring track or guideway becomes only half of the number of cycles for the mould part production, and the periods in which the mould is stationary become correspondingly longer, and this means that approximately double the time will be at disposal for the pouring.

If it be desired, the apparatus may be arranged in such a way that the casting mould is kept stationary until three or even more mould parts have been added.

What is claimed is:

1. A method in the operation of an apparatus for producing castings in casting moulds consisting of identical mould parts which are produced successively by the compression of sand or a similar material in a pressing chamber and are from this chamber fed to a pouring track or guideway on which the casting mould is formed by the mould parts being placed closely together and advanced stepwise through a pouring station, comprising the steps of delivering said mould parts one by one to said pouring track; moving a produced mould part along said pouring track to a preselected position; moving at least one additional mould part along said track to a position upstream of said preselected position where said at least one additional mould part is placed closely together with its immediately preceding mould part to form a casting mould; and repeating said first and second moving steps in sequence so as to move said formed casting mould stepwise through the pouring station with a length of step that is a multiple of the thickness of a mould part.

2. A method as claimed in claim 1 further including the step of simultaneously pouring a number of casting moulds equal to said multiple, following each stepwise advancement.

3. A method as claimed in claim 2 wherein said simultaneously poured casting moulds are adjacent.

4. A method as claimed in claim 1 wherein said at least one additional mould part comprises a single mould part and wherein said length of step is twice the thickness of said mould part.

* * * * *